US009297237B2

(12) United States Patent
Lunde et al.

(10) Patent No.: US 9,297,237 B2
(45) Date of Patent: Mar. 29, 2016

(54) DEADLEG

(75) Inventors: Knud Lunde, Hundvag (NO); Keijo Kinnari, Royneberg (NO); Catherine Labes-Carrier, Hafrsfjord (NO)

(73) Assignee: STATOIL PETROLEUM AS, Stavanger (NO)

( * ) Notice: Subject to any disclaimer, the term of this patent is extended or adjusted under 35 U.S.C. 154(b) by 609 days.

(21) Appl. No.: 12/680,131

(22) PCT Filed: Sep. 23, 2008

(86) PCT No.: PCT/GB2008/003219

§ 371 (c)(1),
(2), (4) Date: Jun. 24, 2010

(87) PCT Pub. No.: WO2009/040511

PCT Pub. Date: Apr. 2, 2009

(65) Prior Publication Data

US 2012/0090686 A1 Apr. 19, 2012

(30) Foreign Application Priority Data

Sep. 25, 2007 (GB) ..... 0718749.5

(51) Int. Cl.
*E21B 41/02* (2006.01)
*E21B 37/06* (2006.01)

(52) U.S. Cl.
CPC ..... *E21B 37/06* (2013.01); *E21B 41/02* (2013.01); *Y10T 29/49* (2015.01); *Y10T 137/0318* (2015.04)

(58) Field of Classification Search
CPC . E21B 41/02; Y10T 37/0419; Y10T 37/0424; Y10T 37/0402
USPC ..... 166/75.15, 242.5, 373, 316, 310
See application file for complete search history.

(56) References Cited

U.S. PATENT DOCUMENTS

| | | | | |
|---|---|---|---|---|
| 3,065,793 | A * | 11/1962 | Page | 166/72 |
| 3,545,886 | A * | 12/1970 | Chalom | 417/196 |
| 4,060,140 | A * | 11/1977 | Barrington | 175/7 |
| 4,102,401 | A | 7/1978 | Erbstoesser | |
| 4,163,477 | A * | 8/1979 | Johnson et al. | 166/363 |
| 4,444,401 | A * | 4/1984 | Roche et al. | 277/327 |
| 4,448,709 | A * | 5/1984 | Bullen | 366/241 |
| 4,988,389 | A * | 1/1991 | Adamache et al. | 166/302 |
| 6,062,308 | A | 5/2000 | Flood | |
| 6,681,795 | B2 * | 1/2004 | Beals et al. | 137/318 |
| 8,122,949 | B2 * | 2/2012 | Cherewyk | 166/90.1 |

(Continued)

FOREIGN PATENT DOCUMENTS

| | | |
|---|---|---|
| CA | 1273566 | 9/1990 |
| WO | WO2007/055592 | 5/2007 |

OTHER PUBLICATIONS

Herrmann. B. et al: "Hydrate Inhibition in Headers with no Production Flow" SPE Annual Technical Conference and Exhibition, SPE 90127, Sep. 26, 2004-Sep. 29, 2004 pp. 1-9 XP002516302 Houston, Texas The whole document Figures 1-15 Figures 6, 8.

(Continued)

*Primary Examiner* — Kevin Murphy
*Assistant Examiner* — Daphne M Barry
(74) *Attorney, Agent, or Firm* — Patterson Thuente Pedersen, P.A.

(57) ABSTRACT

An essentially cylindrical deadleg having a first cross sectional area at one end of the deadleg and a second cross sectional area, the first cross sectional area being smaller than the second cross sectional area.

10 Claims, 1 Drawing Sheet

(56) References Cited

U.S. PATENT DOCUMENTS

| | | | | |
|---|---|---|---|---|
| 8,844,652 | B2 * | 9/2014 | Sokol | E21B 7/02 166/84.2 |
| 2004/0256109 | A1 * | 12/2004 | Johnson | 166/369 |
| 2005/0085676 | A1 | 4/2005 | Panchalingam et al. | |
| 2005/0284504 | A1 | 12/2005 | Kinnari et al. | |
| 2006/0254822 | A1 * | 11/2006 | Ayling | 175/57 |
| 2007/0001447 | A1 * | 1/2007 | Fennington, Jr. | 285/133.11 |

OTHER PUBLICATIONS

Andersen, Hilde: "Computational Study of Heat Transfer in Subsea Deadlegs for Evaluation of Possible Hydrate Formation" Thesis, Telemark University College [Online] Jun. 1, 2007 p. 56pp, XP007907310 PORSGRUNN Retrieved from the Internet: URL:http://teora.hit.no/dspace/bitstraem/2282/413/1/Rapport.pdf>.

Office Action dated Jul. 13, 2012 for Eurasian Patent Application No. 201070393, 5 pages.

Office Action dated Jul. 25, 2012 for Indonesian Patent Application No. W-00 2010 00965, 1 page.

Office Action dated Sep. 29, 2011 for Eurasian Patent Application No. 201070393, 4 pages.

Office Action dated Sep. 4, 2012 for Mexican Patent Application No. MX/a/2010/003311, 3 pages.

Preliminary Search Report and Written Opinion dated Mar. 30, 2010 for PCT Application No. GB2008/003219, 7 pages.

B. Herrmann et al, "Hydrate Inhibition in Headers With No Production Flow", SPE 90127, Sep. 26, 2004, 9 pages.

Search Report dated May 23, 2011 for GB Application No. GB0718749.5, 5 pages.

Office Action issued after Oct. 30, 2012 for Mexican Patent Application No. MX/a/2010/003311, 3 pages.

* cited by examiner

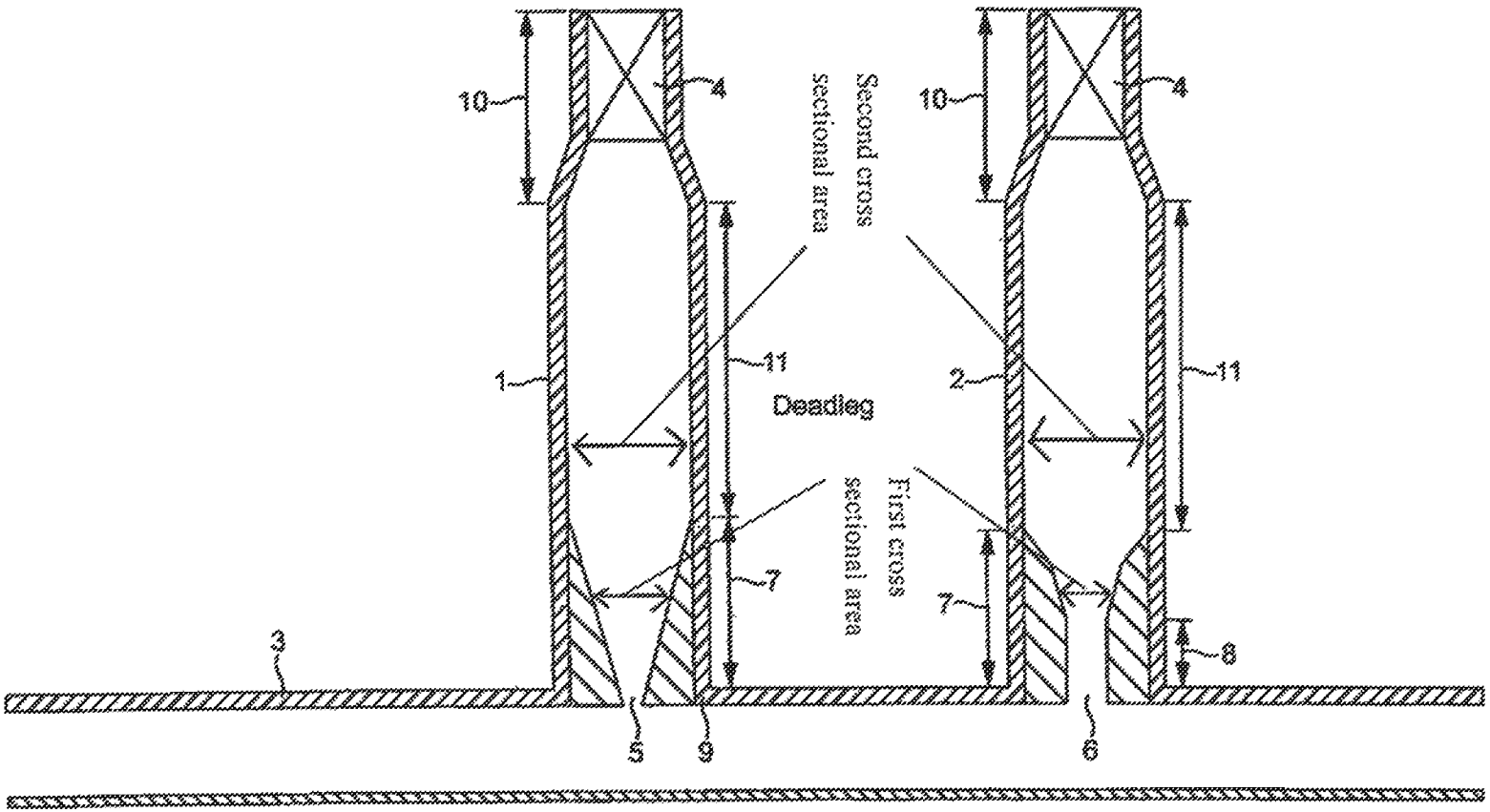
Second cross
sectional area
Deadleg
First cross
sectional area
1
2
3
4
5
6
7
8
9
10
11

DEADLEG

PRIORITY CLAIM

The present application is a National Phase entry of PCT Application No. PCT/GB2008/003219, filed Sep. 23, 2008, which claims priority from British Application No. 0718749.5, filed Sep. 25, 2007, the disclosures of which are hereby incorporate by reference herein in their entirety.

TECHNICAL FIELD

This invention concerns a new deadleg design for preventing the formation of or reducing the incidence of hydrate plugs in deadlegs in oil and gas production systems. In particular, the invention relates to the use of a deadleg whose diameter is larger than required from a traditional design point of view. The deadleg comprises in addition an inlet which restricts the amount of water that can enter the deadleg.

BACKGROUND ART

Gas hydrates, or simply hydrates, are clathrate compounds, i.e. inclusion complexes, formed by the reaction of molecules of water and another substance such as small hydrocarbon molecules, nitrogen, carbon dioxide and hydrogen sulphide. These molecules are called guest molecules. These stabilize the hydrate structure giving much higher melting temperatures than for ice at elevated pressures.

The melting temperature of hydrates increases relatively fast with pressure. Thus, by way of indication, the melting temperature is typically about 10° C. at a pressure of 20 bars, 15° C. at a pressure of 50 bars, 20° C. at a pressure of 100 bars, and 22° C. at a pressure of 200 bars. Large variations in these values may however exist as a result of variations in fluid composition.

As sea temperatures in places like the North sea, Gulf of Mexico, West Africa and Asia are typically around 4° C. and the pressure that exists in the wells or pipes often lies in the range 50 bars to 300 bars, hydrate formation is a major issue during oil and gas production around the globe as the initially warm, water saturated, fluid from the oil well is cooled in the production pipelines by its surroundings causing condensation which may cause hydrate formation. Production in arctic regions or northern deep water areas increases further the possibilities for hydrate formation due to the even lower ambient temperature. The ambient temperature can in these cases be into the subzero region.

Hydrates can form in all kinds of different pipelines used in oil and gas production and to prevent their formation, it is general practice to insert antifreeze liquids, in particular methanol and MEG (monoethylene glycol), into wells or pipes for the purpose of lowering the melting point of the mixture very significantly.

The antifreeze compounds need to be injected into the main pipeline through chemical injection lines. For operational reasons these lines are equipped with a valve which will be closed when no injection is taking place. Thus the pipe connecting the valve with the main pipeline is forming a section with no flow, i.e. a deadleg. If these deadlegs themselves become blocked by hydrate formation then antifreeze material cannot be injected into the main pipeline and the problems of hydrate formation in the main pipe can lead to shutdown and perhaps into the use of a thruster pig to unblock the pipeline (e.g. see US 2005/0284504). The problem of hydrate formation in deadlegs is also acute as, unlike a main pipeline, there is no constant flow in a deadleg. The constant flow of material through a main pipeline serves, at least in part, to prevent the formation of hydrates as these can be urged through the pipe by the warm flowing oil and gases. In a deadleg where there is no flow, hydrates can therefore form more readily as the conditions therein are more likely to be within the thermodynamic hydrate formation region.

The present invention concerns the prevention of plugging in deadlegs. A deadleg is a closed pipe with no flow which is connected to a main pipe which contains a flowing fluid.

It is critical therefore that the deadleg itself remains blockage free. The problem with deadlegs however, is that they are used only intermittently and are therefore particularly prone to plugging.

Despite the problems of hydrate formation being well documented in main pipelines, the problem of hydrate formation in deadlegs does not appear to be documented in the prior art and no-one appears to have addressed the issue of hydrates blocking deadlegs before, at least in the framework of this present invention. As noted above, the issue is connected to hydrate growth on the deadleg wall due to water condensation on the cold wall of the deadleg as warm gas saturated with water enters the deadleg from the main pipe. Such warm gases can easily be transported over distances of several pipe diameters as a result of mixing cells within the main pipe. These mixing cells are generated by the bypassing flowing fluid in the main pipe. The size and number of these mixing cells depends on the geometric design of the region around the deadleg, the fluid velocities and the gas and liquid content. Humid gas can, however, be transported several pipe diameters into a deadleg. Given sufficient time, the growing hydrate layer may gradually block a cross-section of the whole deadleg or at least create large deposits within the deadleg. This can have dramatic effects on oil production both from a regularity and safety point of view.

Hydrate plugs in a deadleg can represent a high operational safety risk. For example, when a valve in a deadleg is opened, there may be a pressure gradient across the valve or a large pressure gradient can be formed over a possible plug as a result of the subsequent operations. The pressure gradient can loosen the hydrate plug creating a high speed projectile. The consequences of a large lump of ice like material moving through a pipe are potentially enormous with the risk of operator fatalities or at least large material damage. Even the presence of large deposits on the deadleg wall can cause a serious safety hazard. For example, in the case of the deadleg being a part of depressurization system, hydrate deposits may be loosened during the depressurization operation and can plug a valve downstream of the deposit location. As a result of this a high pressure difference is caused which may create a high speed projectile with very serious consequences.

Several solutions exist to avoid hydrate formation in pipes in general. For pipes in onshore or topside installations, heat tracing is often used. Thus, heat can be applied to the pipe by placing a steam line or electric heating element adjacent to the line in the area of plug formation. In practice however, this technique can fail due to malfunctioning of the heating system or due to human error.

A further option for preventing hydrate formation is the use of insulation. Thermal insulation alone may provide sufficient protection against hydrate formation if the length of the deadleg is sufficiently short. No general methodology, however, exists to determine the acceptable length of a deadleg. Design is often done without being aware of the possibility of hydrate plugging. Incidents are known where such hydrate plugs have occurred even in insulated deadleg sections. Other solutions include the application of chemicals. This requires chemical injection points and adds to the cost capital and operational expenditure. In addition due to environmental concerns and product value considerations there is currently a large incentive not to use chemicals.

In the case of deadlegs, the use of chemical injection would also require regular operator action. There always exists a risk that such infrequent operations may be forgotten thus increasing the risk for creating a hydrate problem.

The challenges of hydrate plug removal are exacerbated in subsea systems as lower temperatures generally encourage hydrate formation. The present inventors have found that in some cases plugged deadlegs can be avoided by shortening the deadleg length by installing a valve closer to the warm main pipe. The acceptable distance is determined by complex calculations and can vary from case to case but this technique is limited as it will not always be possible to install a valve close enough to the main pipe to reduce the deadleg length.

Use of insulation can considerably increase the serviceable length of a deadleg but will not eliminate the problem of hydrate plugging for long deadlegs.

More complex techniques for preventing hydrate formation include devices for increasing the heat transfer characteristics of the pipe. These include use of a container built around the deadleg which contains water. Water is warmed up by the warm main pipe, and temperature differences generate convective flow within the container thus warming the deadleg to a larger distance from the main pipe than without such container.

Another solution is the use of a large mass of material with good heat conduction on the outside of the pipe to increase the heat conduction and thus increase the temperature within the pipe.

In principal, these solutions may also be used in surface applications although the cost of their use may be unnecessary in the more accessible surface pipes.

There remains, however, the need to devise further solutions to the formation of hydrate plugs in deadlegs, in particular solutions which are cheap and easily applied to any deadleg whether underwater or on the surface.

SUMMARY OF THE INVENTION

The present invention provides a new solution to avoid hydrate plug formation or to increase the time interval between hydrate plug formation in deadlegs. As well as obvious benefits in terms of preventing operational interruptions, by preventing hydrate plug formation, a skilled professional is then able to use longer deadlegs and hence extend the distance between the valve and the connection of the deadleg to the main pipe. This can have large practical implications with respect to design for remotely operated vehicle (ROV) operation. Due to place limitations the ROV may only operate at certain locations. Therefore it is important that the valves are located at certain levels. This requirement can in certain cases result in long deadlegs.

The invention concerns a new deadleg design which is free of complicated mechanical elements or moving parts and which provides a robust solution to the problem of hydrate plugging without recourse to the more complex solutions discussed above.

The inventors have realized that the larger the diameter of the deadleg, the less likely it is to plug. Currently, deadlegs are designed to be as narrow as possible for the use to which they are to be put. Thus, where a deadleg is to be used for injection of chemicals into the main pipe, the deadleg is designed to have a diameter that is just large enough to accommodate the chemical injection rate required. Typically the diameter of such pipes varies from 0.5 cm to 15 cm, typically up to 5 cm. Even larger diameters than 15 cm are however also possible.

The present inventors have realized that by using deadlegs that are as narrow as possible the person skilled in the art is unconsciously encouraging hydrate formation. There is in fact no requirement to use a deadleg which is particularly narrow other than to limit maximum flow rates through these pipe sections and to minimize cost but the inventors have realized that the additional cost of using a larger deadleg is minor in comparison to the savings that are made if hydrate formation is avoided. Moreover, flow rates can be limited if part of the deadleg has a narrowed orifice, there being no need for the whole deadleg to be of the same diameter.

As a first step therefore, the inventors have realized that using a wider deadleg is advantageous. Thus, in one embodiment of the invention, the diameter of the deadleg is enlarged in order to accommodate a larger amount of hydrate and postpone or prevent the onset of plugging (relative to a narrower deadleg operating under otherwise identical conditions). The use of a wider deadleg might not however, eliminate hydrate growth entirely. Simply widening the deadleg is only a suitable solution on its own therefore where hydrates can be prevented in their entirety or where even if hydrates do form to a small degree the loosening of hydrate deposits would not cause any safety issues.

The increase in the diameter of the deadleg also has a positive impact on the distance mixing cells can cover. As larger mixing cells means a smoothening in temperature fluctuation over a longer distance, temperatures over the hydrate formation minimum can be spread over a greater portion of the deadleg.

The inventors have found out through rigorous calculations and operation experience that acceptable deadleg lengths must typically be of the order of 5-10 times the pipe diameter of insulated pipe and 3 to 5 times the diameter of uninsulated pipe. These lengths may be extended in cases with more favorable flowing direction and geometry. An increase in the pipe diameter can extend the maximum viable length of the dead leg. However, increasing the diameter of the pipe has the additional draw back that the connection to the main pipe is also larger meaning that more water saturated gas from the main pipe can enter the deadleg and hence there is further potential for hydrate formation and deposition on the wall beyond the region where temperature is high enough to avoid hydrate formation.

The second step in the invention is to modify the inlet to the deadleg from the main pipeline so as to narrow the inlet opening. The inventors have realized that by using an inlet which is narrower than the rest of the deadleg, the inlet will hinder or restrict gas from the main pipe from penetrating into the deadleg and will thus reduce the mass flow of water into the deadleg volume. The specific dimensions of the inlet can be determined by the required rates to transport the expected fluid through the dead leg when in operation. Thus, where previously the person skilled in the art determined that a deadleg should be 2 cm in diameter in order to accommodate the material it was required to transport, the inlet may be 2 cm in diameter or less with the main body of the deadleg being broader to reduce or prevent hydrate formation.

The present inventors have thus realized that to minimize hydrate formation the deadleg should have a narrow diameter inlet from the main pipe which broadens out to a deadleg pipe of larger diameter.

Thus, viewed from one aspect the invention provides a method for manufacturing a deadleg comprising:

determining the minimum diameter of a deadleg based on the amount of material it is required to carry;

manufacturing a pipe having a diameter of at least 1.25 times greater than said minimum diameter.

Viewed from another aspect the invention provides a method for manufacturing a deadleg comprising:

determining the minimum diameter of a deadleg based on the amount of material it is required to carry;

when said minimum diameter is less than 5 cm, manufacturing a pipe having a diameter of at least 10 cm, preferably at least 15 cm, more preferably at least 20 cm;

or when said minimum diameter is greater than 5 cm, manufacturing a pipe having a diameter of at least 1.25 times greater than said minimum diameter.

Viewed from another aspect the invention provides an essentially cylindrical deadleg having an inlet at one end thereof and a valve at the other, the inlet being arranged to allow material to enter the deadleg from a main pipe to which the deadleg is attached or leave the deadleg into the main pipe, the valve being capable of allowing release of material from the deadleg or entry of material into the deadleg characterised in that the inlet has a diameter of no more than 80% of the broadest diameter of deadleg.

Viewed from another aspect the invention provides a method for manufacturing a deadleg comprising:

determining the minimum diameter of a deadleg based on the amount of material it is required to carry;

when said minimum diameter is less than 5 cm, manufacturing a pipe having a diameter of at least 10 cm, preferably at least 15 cm, more preferably at least 20 cm or when said minimum diameter is greater than 5 cm, manufacturing a pipe having a diameter of at least 1.25 times greater than said minimum diameter;

providing said pipe with an inlet at one end thereof and a valve at the other, the inlet being arranged to allow material to enter the deadleg from a main pipe to which the deadleg is attached in use or leave the deadleg into the main pipe, the valve being capable of allowing release of material from the deadleg or entry of material into the deadleg wherein the inlet has a diameter of no more than 80% of the broadest diameter of deadleg.

Viewed from another aspect the invention provides a process for the prevention or reduction of hydrate formation in a deadleg comprising using a deadleg as hereinbefore defined.

Viewed from another aspect the invention provides use of a deadleg as hereinbefore defined in the prevention or reduction of hydrate formation.

Alternatively viewed the invention provides a cylindrical deadleg having a first cross sectional area at one end of said deadleg and a second cross sectional area, said first cross sectional area being smaller than said second cross sectional area.

In a further embodiment the invention provides an essentially cylindrical deadleg having an inlet at one end thereof in which at least a portion of the deadleg is expanded to prevent hydrate formation in the deadleg.

DETAILED DESCRIPTION

By deadleg is meant a pipe in which in use there is not a constant flow of material therethrough. In use the deadleg is connected to a main pipe in which there is constant flow, e.g. in an oil production process. A deadleg is therefore used intermittently and has periods of idleness where no material flows through the deadleg. A deadleg allows material to be removed from or added into the main pipe. A deadleg is thus explicitly a side pipe from a main pipe in an oil production process and not another type of pipe. The term deadleg is used herein to apply to the deadleg in use and prior to its attachment to the main pipe, it being appreciated that the deadleg is supplied separately from any main pipe.

When in place, a deadleg is closed by the presence of a valve at one end and the mainpipe at the other end thereof. Deadlegs can thus be any closed pipe section in which there is no flow connected to a flowing system. The flowing system can comprise oil and gas production pipelines, well branches connection several well to a manifold, gas and water injection lines, chemical distribution lines or any other service line used for transporting water containing hydrocarbons. Deadlegs are typically formed as a result of a closed valve at a given distance from the main pipe with flowing fluid. When these pipe sections are to be used the valve is open for, inter alia, removal or introduction of hydrocarbons from/into the main pipe, inject chemicals into the main pipe or for other services like depressurization, displacement or circulation of the pipe content.

The distance of the valve in the deadleg to the main pipe depends on the specific design solution and operability requirements. Typically deadlegs are less than 50 m, more typically less than 20 m, in many cases even less than 10 m or even less than 1 m in length. Instrument lines can also form a deadleg when the sensor is located some distance from the main pipe with flowing fluid through. The length of the instrument lines are normally less than 5 m, more typically less than 1 m. Deadlegs may also be formed in a complex subsea pipe network when one or more of the pipes connected to a gathering pipe are temporarily out of production. In this particular case the deadleg length can be up to several kilometers. The state of the art subsea applications involve also use of subsea processing units. The operation of these units require complex piping and valve network. This will necessarily result in several deadlegs.

By main pipe is meant a pipe carrying an oil or gas stream (e.g. well stream from a reservoir) from one location to another (e.g. from reservoir to the surface) during oil production. Main pipe in the context of the invention can also be any other pipe where hydrocarbon and water are flowing together in the pipe and there is sufficient pressure and low enough temperature for hydrate formation to occur in any attached deadlegs.

By essentially cylindrical is meant that the deadleg is cylindrical or almost cylindrical. The deadleg need not be straight, it may contain one or more bends however the cross section of the deadleg will remain essentially circular and the sides of the cylinder at any point are parallel.

By inlet is meant the narrowest orifice between the main pipe and deadleg.

By inlet portion is meant that section of the deadleg adjacent the main pipe whose diameter is narrower than the broadest diameter of the deadleg.

By pipe portion is meant the part of the deadleg from the inlet portion to the valve portion whose diameter is constant and represents the broadest diameter of the deadleg.

By valve portion is meant the portion of the deadleg which incorporates the valve and includes any part of the deadleg adjacent the valve whose diameter is reduced to accommodate the valve.

Unless otherwise stated, diameters are measured internally within any portion of the deadleg, i.e. the diameter is the diameter of the hole in the pipe rather than that of the pipe itself including the walls.

By the minimum diameter of a deadleg based on the amount of material it is required to carry is meant the smallest diameter a deadleg can have to be able to carry out its function. The person skilled in the art is able to determine this diameter based on his knowledge of the amount of material the deadleg needs to carry. For example, to transport 100L of material per second at a particular pressure, a pipe will need to have a certain minimum diameter to be able to transport this amount of material. The person skilled in the art is able to determine this minimum diameter using known mathematics.

The length of the deadleg is the distance from the connection to the main pipe to the end of the valve portion (if present) or the end of the pipe portion if no valve is present.

By at least a portion of the deadleg is expanded is meant that part or all of the deadleg (other than the inlet portion) has a diameter which is increased so as to prevent or reduce the incidence of hydrate plugging.

The deadleg of the invention can be branched from a pipe anywhere in oil or gas production system. The deadleg may thus be subsea, offshore or onshore.

The deadleg may be manufactured from any convenient material such as a metal, alloy, a composite material or plastic. Conveniently, the deadleg will be made from steel. The deadleg will be rigid and can be reinforced as is known in the art. Most conveniently, the deadleg will be a rigid steel pipe. While it is preferred if the deadleg is linear, it is within the scope of the invention for the deadleg to contain bends, e.g. 90° bends. Such a deadleg is still regarded as cylindrical herein as at any point in the deadleg the sides of the deadleg will be the same distance apart, parallel and the cross section of the deadleg will be circular.

The length of the deadleg can vary over wide limits but is typically of the order of 10 cm to 50 m in length, preferably 30 cm to 10 m, especially 50 cm to 2 m.

The broadest diameter of the deadleg will preferably be the same throughout the pipe portion. Preferably, the length of the deadleg is at least 3 times, preferably at least 5 times, more preferably at least 10 times, especially at least 20 times the diameter of the deadleg. Suitable diameters include 0.5 cm to 1 m, preferably 1 to 50 cm, e.g. 2 to 30 cm.

The deadleg has typically a valve positioned at the end furthest from the connection to the main pipe. The valve can be of any appropriate design and allows the person skilled in the art to control the material entering and leaving the deadleg. The diameter of the valve would normally be the size required for the specific use to which the valve is to be put, ignoring any hydrate issues. Normally this would mean a smaller nominal size than that of the deadleg according to the present invention. The valve would therefore be connected to the deadleg through an expanding section with increasing diameter, i.e. the valve portion.

Preferably, the valve will have the same diameter as would have previously been employed in the art. Thus, where the minimum deadleg diameter was previously calculated to be 5 cm, a 5 cm diameter valve would also have been employed. In the deadlegs of the invention, it would again be appropriate to use a 5 cm valve but the pipe portion of the deadleg would be broader than this minimum diameter. It is important that the diameter of the valve is not increased as this would increase cost in a variety of ways. Ideally therefore, the diameter of the valve will be the minimum diameter calculated for the deadleg.

Conveniently, the valve portion can be connected to the rest of the deadleg using appropriate flanges. In construction therefore the deadleg of the invention may comprise only the narrower inlet portion and the pipe portion.

Viewed from another aspect therefore the invention provides an essentially cylindrical deadleg having an inlet at one end thereof, the inlet being arranged to allow material to enter the deadleg from a main pipe to which the deadleg is attached in use or leave the deadleg into the main pipe, wherein the inlet has a diameter of no more than 80% of the broadest diameter of deadleg.

In an preferred embodiment the diameter of the deadleg reduces to accommodate the valve. Preferably therefore the diameter of the deadleg reduces to the same nominal diameter as that of the valve.

The inlet is arranged to allow material to enter the deadleg from a main pipe or leave the deadleg into the main pipe and is narrower than the broadest diameter of the deadleg. In particular, the diameter of the inlet is preferably no more than 80%, e.g. no more than 75% of the broadest diameter of the deadleg, more preferably no more than 50%, especially no more than 25% of the broadest diameter of the deadleg. In general, the smaller the pipe, the larger the percentage reduction which should be employed. Where for example the deadleg is up to 20 cm in diameter the inlet can be 15 cm or less, e.g. 10 cm or less, especially 5 cm or less.

This inlet diameter should be measured based on the narrowest diameter of the inlet portion connecting the main pipe and the deadleg. While it is envisaged that the inlet will be at its narrowest directly adjacent the main pipe, it is within the scope of the invention, for example, for the narrowest part of the inlet portion to be at any point of the inlet portion.

What is required however is that the inlet portion, after the inlet itself eventually broadens in any convenient fashion to have a diameter which is the same as the rest of the diameter of the deadleg. This can be achieved uniformly in a conical shape, stepwise or via a concave or convex surfaces. The narrowest point of the inlet can be maintained for a few cm or can occur just as a point. In one embodiment, the narrow inlet persists throughout the whole of the inlet portion. The person skilled in the art is able to devise all kinds of different inlet designs to meet the requirements of the invention.

In a highly preferred embodiment, a narrowed inlet portion is provided by inserting into the deadleg another pipe whose external diameter matches the internal diameter of the deadleg. In this way, the inlet diameter then becomes the internal diameter of the smaller pipe inserted into the deadleg. In this way a narrow inlet portion can be achieved very cheaply and easily. The narrower pipe can be fixed into the deadleg in any convenient fashion.

It is also within the scope of the invention for the deadleg to be formed from two or more pipes, e.g. one of broad diameter and one of narrow diameter which can be connected to form a deadleg structure in which the narrower pipe forms the inlet portion and the broader pipe forms the pipe portion of the deadleg. A further pipe could be used to form the valve portion of the deadleg.

The length of the inlet portion (i.e. the amount of pipe exhibiting a diameter narrower than the pipe portion of the deadleg) may be up to 10 times the diameter of the inlet of the deadleg, preferably up to 5 times. The longer the inlet portion the less material will be transported up the inlet portion thus reducing the risk of water vapor entering the broader section of the deadleg.

The deadleg can be positioned at any angle to the main pipe. Conveniently it may be perpendicular to the pipe, but this is not essential. In some situations, it may be beneficial to be able to inject material into the main pipe from the deadleg either against the main flow of material in the pipe or with the flow of material in the pipe. In this scenario, it may be beneficial if the deadleg is positioned at an acute angle to the pipe.

The deadleg may be positioned horizontally or vertically depending on the orientation of the pipe from which it branches. Conveniently the deadleg will be in a vertical position or positioned so that material added into the pipe travels downwards under gravity into the main pipe.

The inlet may be fabricated from the same material as the deadleg itself or from any other convenient material. In an embodiment, the inlet is formed from a material having excellent thermal conductivity, e.g. steel. In this way, the temperature in the narrow inlet portion of the deadleg is maintained high as heat from the main pipe is carried through to the inlet section. The higher temperature prevents formation of hydrates in this part of the deadleg. Moreover, as the deadleg is preferably positioned so that material entering the deadleg flows downwards, should any water condense in the deadleg, this will have a tendency to flow downwards towards the inlet section and hence the hotter surfaces of the inlet section. The hot surfaces of the inlet section are then able to prevent hydrate formation throughout the deadleg by evaporating any condensed material which flows down to the inlet section.

The whole deadleg can be insulated as is known in the art. It may, however, be preferable not to insulate the deadleg. Where there is no insulation present, the temperature in the section adjacent the inlet portion is cooler. This encourages water condensation close to the inlet portion which can then flow, under gravity, back into the main pipe.

The pipe portion above the inlet portion can be extended to the desired length with respect to the design requirements as previously depicted.

Deadlegs in which material flows regularly suffer from less hydrate formation as their constant use does not give much time for hydrate formation to occur. The invention is thus most useful in deadlegs where material flows intermittently, e.g. is injected infrequently. Such a deadleg might be used for chemical injection which are only periodically in use or to transfer material from one pipe to another. The deadleg design of the invention may also be used for safety systems, e.g. depressurization lines for emergency shutdowns. Such systems comprises a pressure safety valve (PSV), which is connected to the production system through a deadleg.

The invention would also be useful where heat tracing is used. It would provide additional built in safety function in a passive way and the PSV (incl. the deadleg) design would not solely rely on the active use of heat tracing which might be malfunctioning without the operator being aware of it.

As noted above, in some embodiments of the invention, it is preferable to ensure that the diameter of the deadleg is broader than is actually required for its use. In order to ensure that this is the case, it is necessary to determine the minimum diameter required for the deadleg. Calculating the required diameter of a deadleg depends on the nature of the deadleg in question but can be carried out by the person skilled in the art. For example, if the deadleg is to be used for injecting chemicals into the main pipe, then the narrowest diameter of the deadleg can be calculated based on the amount of chemical which needs to be injected into the main pipe and the rate at which injection is required.

Where a deadleg is designed to allow transport of material from one main pipe to another then the minimum diameter of pipe can be again calculated based on the amount of material to be transferred and the rate of transfer desired based on similar calculations to the above.

Once the minimum diameter has been determined, the present invention requires that the main part of the deadleg should have a diameter which is at least 1.25 times this minimum diameter, e.g. at least 1.5 times, especially at least 1.75 times, most especially 2 times the minimum diameter. In some embodiments, the diameter of the deadleg should have a diameter which is at least 3 times, e.g. 4 times this minimum diameter. This is particularly applicable for narrow diameter deadlegs, e.g. those whose minimum diameter is 5 cm or less. Narrower deadlegs are more prone to plugging so a more significant increase in the diameter of a narrow diameter deadleg (e.g. one less than 5 cm in diameter) is preferred.

The inlet should have a diameter which is the same or less than the narrowest diameter calculated above.

The deadleg can be connected to the main pipe in any convenient fashion. For example, the deadleg can be provided with a flange which can be bolted to a suitable corresponding flange on the main pipe.

Reference is now made to FIG. 1 which is a schematic illustration of two deadlegs (1,2) attached to a main pipe (3). Each deadleg has a valve (4) present in valve portion (10) through which material can be removed from or added into the deadleg. The deadleg preferably narrows where the valve is fitted.

The deadlegs have inlets (5,6) which are narrower than the rest of the deadleg. In deadleg (1), the inlet portion (7) broadens uniformly in a conical shape to the width of the pipe portion (11). In deadleg (2), the inlet contains an extended portion (8) of the same diameter as the inlet, the inlet portion (7) broadening over a concave surface to the width of the pipe portion (11).

Viewed from another aspect therefore the invention provides an essentially cylindrical deadleg having an inlet portion, a pipe portion and a valve portion, said inlet portion being adapted in use to be adjacent to a main pipe and comprising an inlet;

said valve portion being positioned at the opposite end of the deadleg to said inlet portion and comprising a valve;

said pipe portion is positioned between said inlet portion and said valve portion;

wherein the inlet has a diameter of no more than 80% of the diameter of pipe portion.

The invention claimed is:

1. A device configured to reduce formation of hydrate plugs in an oil or gas pipeline, the pipeline adapted for use in a subsea environment presenting ambient subsea pressures and temperatures conducive to the formation of hydrates within the pipeline, the pipeline including a main pipe adapted for use in said subsea environment and adapted for operable coupling to a subsea oil reservoir for transporting fluids from said subsea reservoir in an oil or gas production process, the main pipe presenting a main pipe internal flow channel and having a main pipe longitudinal flow axis and a main pipe external surface, the device comprising:

a deadleg through which there is no constant flow of material during an oil or gas production process for extracting fluid from the subsea reservoir and transporting said fluid through said main pipe, the deadleg configured as a side pipe operably coupled to said main pipe external surface such that said deadleg is subject to the same subsea environment presenting ambient subsea pressures and temperatures conducive to the formation of hydrates as said main pipe, the deadleg presenting an internal deadleg chamber in fluid communication with said main pipe internal flow channel, a deadleg inlet configured to enable material to be removed from or added into the main pipe through said deadleg inlet, the deadleg chamber having a first internal cross sectional area perpendicular to a main axis of the deadleg at or near said inlet presenting a deadleg first internal chamber uninterrupted diameter and a second internal cross sectional area perpendicular to the main axis of the deadleg and further away from the deadleg inlet than the first cross sectional area, the second internal cross sectional area presenting a second internal chamber uninterrupted diameter, said first internal chamber diameter being smaller than said second internal chamber diameter, whereby the flow rate of material through said deadleg inlet is limited and hydrate formation within the internal chamber of the deadleg is inhibited by the mutual relative sizes of the first and second internal chamber diameters, notwithstanding the operation of said pipeline within a subsea environment presenting ambient subsea pressures and temperatures conducive to the formation of hydrates.

2. The device of claim 1, the inlet being arranged to enable material to enter the deadleg from a main pipe to which the deadleg is attached in use or leave the deadleg into the main pipe, wherein the first internal cross sectional area has a diameter of no more than 80% of the second internal cross sectional diameter.

3. The device of claim 2 further comprising a valve positioned within the deadleg at an end of the deadleg opposite the inlet, wherein the valve is capable of selectively allowing release of material from the deadleg or entry of material into the deadleg.

4. The device of claim 2 having an inlet portion, a pipe portion and a valve portion, said inlet portion being adapted in use to be adjacent to said main pipe and comprising said inlet;

said valve portion being positioned at the opposite end of the deadleg to said inlet portion and comprising a valve;

said pipe portion is positioned between said inlet portion and said valve portion;

wherein the inlet has a diameter of no more than 80% of the diameter of the pipe portion.

5. The device of claim 1, said first and second internal cross sectional areas being generally circular.

6. A device configured to reduce formation of hydrate plugs in oil or gas pipelines, the device comprising a deadleg configured as a side pipe connected to and extending outwardly from an outer side surface of a main pipe in an oil or gas production process, the main pipe adapted for use in a subsea environment presenting ambient subsea pressures and temperatures conducive to the formation of hydrates, the main pipe further adapted for operable coupling to a subsea oil reservoir for transporting fluids from said subsea reservoir, the deadleg subject to the same subsea environment presenting ambient subsea pressures and temperatures conducive to the formation of hydrates as said main pipe, the deadleg comprising structure presenting an internal chamber and an inlet, the inlet configured to enable material to be removed from or added into the main pipe through the deadleg, the deadleg having a first internal cross sectional area having an uninterrupted diameter and oriented perpendicular to a longitudinal axis of the side pipe at one end of said deadleg at or near the inlet and a second generally circular internal cross sectional area having an uninterrupted diameter and oriented perpendicular to the longitudinal axis of the side pipe further away from the inlet when compared to the first generally circular internal cross sectional area, said first generally circular internal cross sectional area being smaller than said second internal cross sectional area, whereby the flow rate of material through said inlet is limited and hydrate formation within the internal chamber of the deadleg is inhibited by the mutual relative sizes of the first and second internal chamber diameters, notwithstanding the operation of said main pipe and said deadleg within a subsea environment presenting ambient subsea pressures and temperatures conducive to the formation of hydrates.

7. The device of claim 6, the inlet being arranged to enable material to enter the deadleg from a main pipe to which the deadleg is attached in use or leave the deadleg into the main pipe, wherein the first internal cross sectional area has a diameter of no more than 80% of the second cross sectional area diameter.

8. The device of claim 7 further comprising a valve positioned within the deadleg at or near an end of the deadleg opposite the end comprising the inlet, wherein the valve is capable of selectively allowing release of material from the deadleg or entry of material into the deadleg.

9. The device of claim 7 having an inlet portion, a pipe portion and a valve portion, said inlet portion being adapted in use to be adjacent to a main pipe and comprising said inlet;

said valve portion being positioned at the opposite end of the deadleg to said inlet portion and comprising said valve;

said pipe portion is positioned between said inlet portion and said valve portion;

wherein the inlet has a diameter of no more than 80% of the diameter of the pipe portion.

10. The device of claim 6, said first and second internal cross sectional areas being generally circular.

* * * * *